United States Patent [19]

Schapker

[11] 3,939,616

[45] Feb. 24, 1976

[54] RAIN WATER RUN-OFF DISPERSER

[76] Inventor: Richard L. Schapker, 134 Farnum St., North Andover, Mass. 01845

[22] Filed: Jan. 3, 1975

[21] Appl. No.: 538,364

Related U.S. Application Data

[63] Continuation-in-part of Ser. No. 382,758, July 26, 1973, abandoned.

[52] U.S. Cl. ..... 52/94; 52/97; 219/213

[51] Int. Cl.[2] ..... E04D 13/00

[58] Field of Search ..... 52/97, 24, 12, 73, 94, 52/57, 74, 95, 96; 210/474, 153, 154, 162; 219/213

[56] References Cited

UNITED STATES PATENTS

| | | | |
|---|---|---|---|
| 2,271,081 | 1/1942 | Layton | 52/12 |
| 2,699,484 | 1/1955 | Michaels | 52/94 |
| 3,735,540 | 5/1973 | Thaler | 52/96 |

*Primary Examiner*—John E. Murtagh

[57] ABSTRACT

A rain water run-off disperser comprising mounting means, and multiple fixed deflecting surfaces spaced below a roof edge of a building in the path of water falling therefrom and preferably inclined downwardly and outwardly from said building, said deflecting surfaces deflecting water away from said building and breaking up the same into a relatively fine and dispersed shower of drops.

6 Claims, 13 Drawing Figures

FIG 1
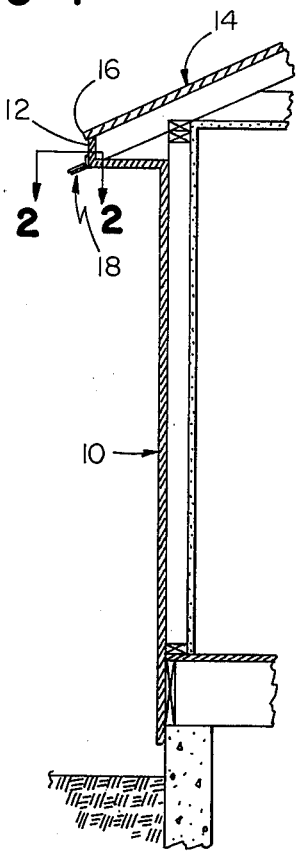
FIG 2
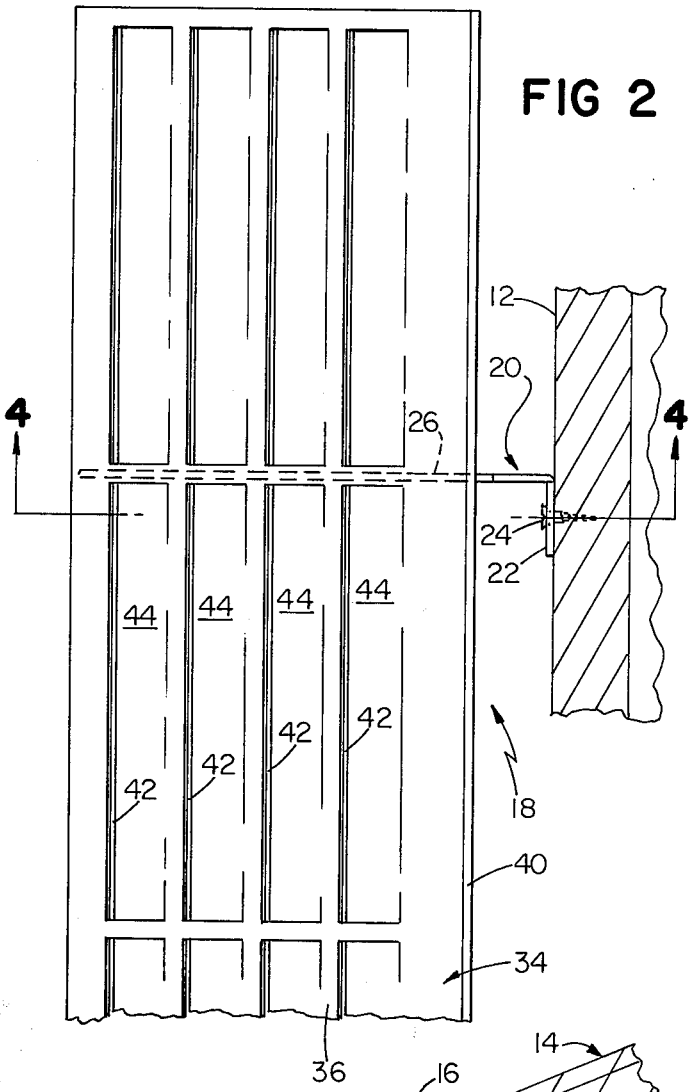
FIG 3
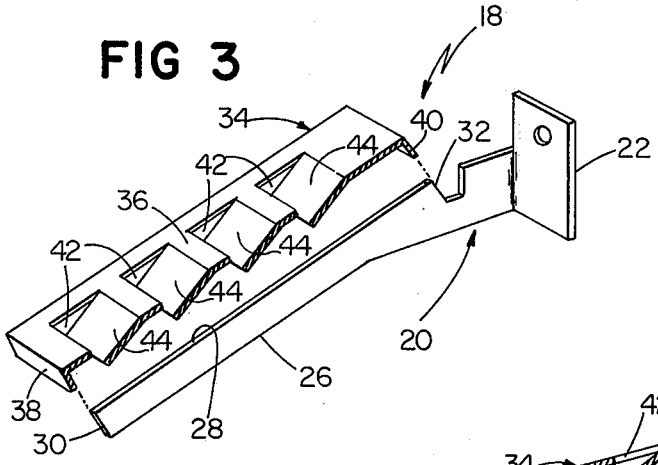
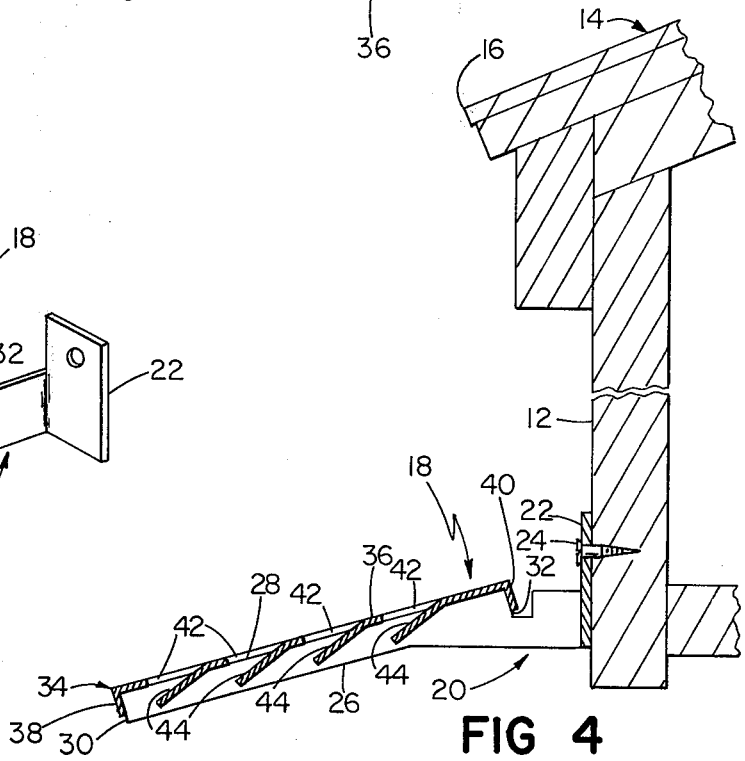
FIG 4

FIG 5
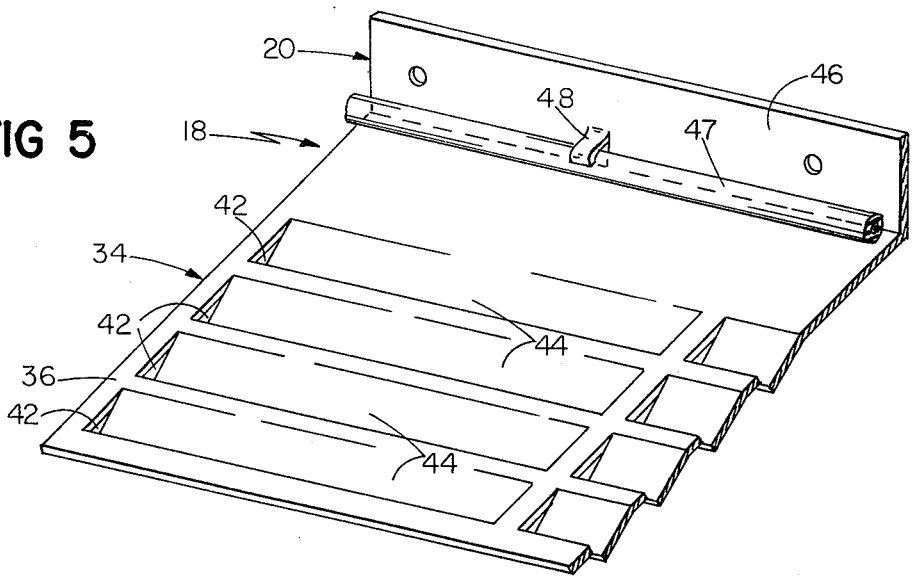
FIG 6
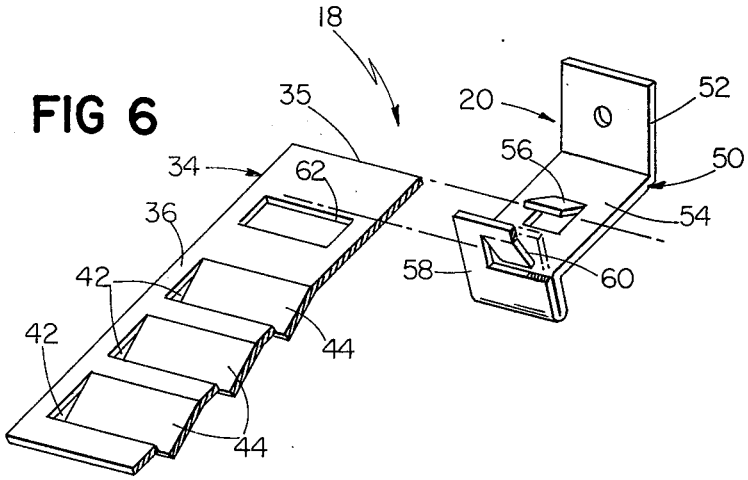
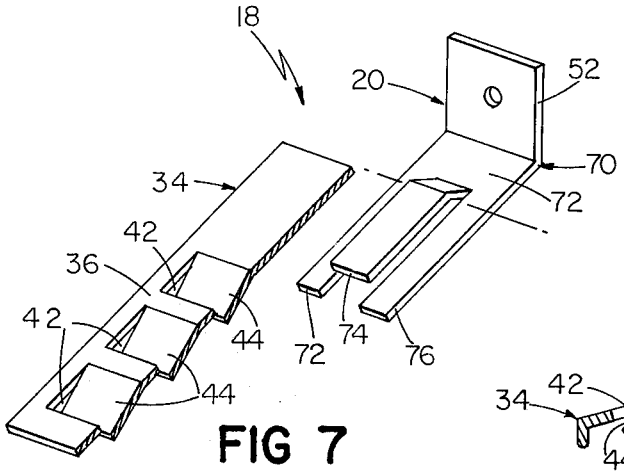
FIG 7
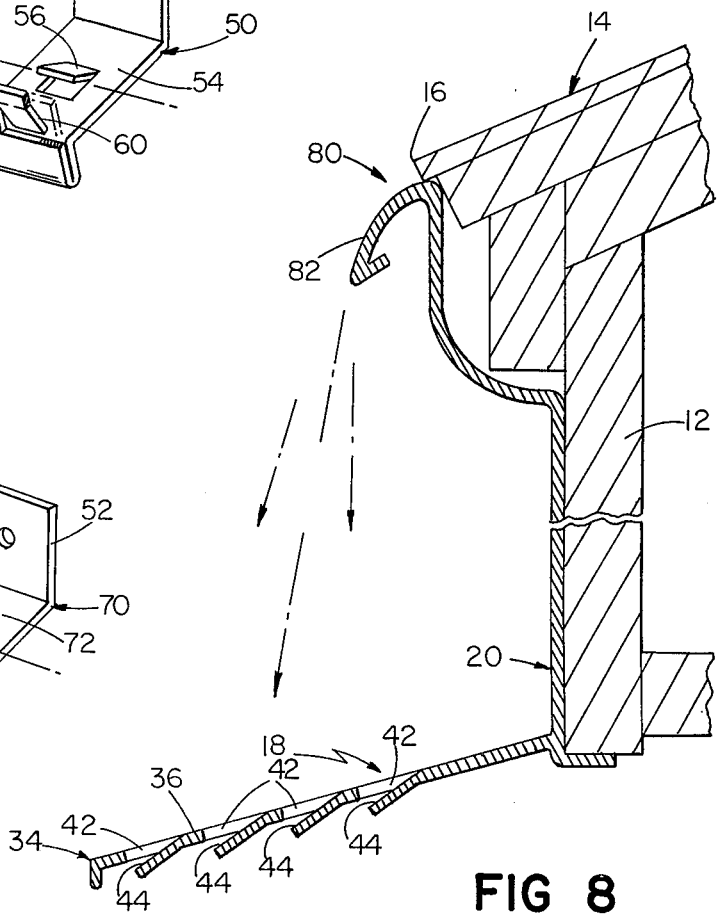
FIG 8

RAIN WATER RUN-OFF DISPERSER

This application is a continuation-in-part of co-pending application Ser. No. 382,758, filed July 26, 1973, now abandoned entitled RAIN WATER RUN-OFF DISPERSER.

BACKGROUND OF THE INVENTION

1. Field of the Invention

The present invention relates to the controlled dispersion of rain water run-off from buildings. In particular, this invention provides means for the dispersal of the substantially planar run-off from roof edges, eliminating the undesirable effects of said run-off, and thereby alleviating the need for gutters.

2. Description of the Prior Art

Hitherto, rain water run-off from building roofs has been controlled by installation of gutters or by simply letting the run-off fall to ground level in an unimpeded manner.

Gutters generally provide means for conducting water run-off to a downspout, which discharges into a localized region at ground level. While this is satisfactory in many instances, nevertheless maintenance of free flow in gutters can be time-consuming and expensive because of leaves, ice formation, and deterioration requiring replacement. Consequently, many homeowners simply omit gutters from their dwellings.

Without gutters, rain water runs off the roof edges in a substantially planar manner and, being unimpeded in its downward fall, is accelerated by gravity to a high velocity. In conjunction with the planar nature of the run-off, the high velocity at impact with the ground below is sufficient to cause the formation of a small trench in the ground immediately below the roof line. This erosive effect is unsightly, and may even be damaging to desired landscaping, flower beds, bushes, etc. In addition, the resultant splashing can transport soil particles to vertical building surfaces, whereupon they adhere to cause further unsightly conditions. Such a situation can be partially alleviated by installation of suitable capturing and drainage means at ground level, for example, brick or cement troughs, or inverted roofing tiles. However, this can be impractical because of improper slopes, flower or bush arrangements.

SUMMARY OF THE INVENTION

Principal objects of this invention are to provide run-off water dispersal means: eliminating the need for gutters and at the same time avoiding the deleterious effects of unimpeded run-off; which are not susceptible to the accumulation of leaves or other matter; which are simpler and less costly to install than gutters; and which will solve the run-off problem while adaptable to many different types of dwellings and roof designs.

According to the invention deflective means are provided such that water run-off, upon arrival at ground level, is dispersed in a random pattern of small droplets. In general, this invention features non water-collecting means for mounting a disperser in a position horizontally aligned a limited spaced distance below the edge of a roof and a substantial distance above the ground in the path of water falling therefrom. The disperser connected to the mounting means comprises an elongated structure for positioning beneath the roof edge and having a width sufficient to intercept the path of the falling water. The disperser structure defines a multiplicity of separate paths to separate and disperse water falling thereon into a shower of water over an extended area of the ground. In preferred embodiments such means comprise a plurality of apertures provided across the width of the disperser and deflecting surfaces at the apertures connected by width-wise structural and spacing elements so as to maintain fixed inclination downward and outward from a building thereby to disperse water in a direction downwardly away from the building to which the disperser is attached. In preferred embodiments the mounting means are detachable from the disperser and the disperser is inclined slightly downwardly away from the building as well.

BRIEF DESCRIPTION OF THE DRAWINGS

Other objects, features and advantages of this invention will be apparent to those skilled in the art from the following detailed description of preferred embodiments thereof taken together with the accompanying drawings, in which:

FIG. 1 is a sectional end view of a disperser according to the invention mounted on a house below a roof edge thereof;

FIG. 2 is an enlarged, fragmentary plan view of the disperser taken along the line 2—2 of FIG. 1;

FIG. 3 is a fragmentary, isometric, exploded view of the disperser and its mounting bracket;

FIG. 4 is an enlarged view similar to that of FIG. 1 of the mounted disperser, in section along the line 4—4 of FIG. 2;

FIG. 5 is a fragmentary, isometric view of an alternate embodiment of the disperser including integral mounting means and a heating cable;

FIGS. 6 and 7 are fragmentary, isometric, exploded views of alternate embodiments of the disperser and alternate bracket mounting means therefor;

FIG. 8 is a view similar to that of FIG. 4 illustrating yet another embodiment of the invention in association with rain run-off guide means.

DESCRIPTION OF THE PREFERRED EMBODIMENTS

Figure 9:
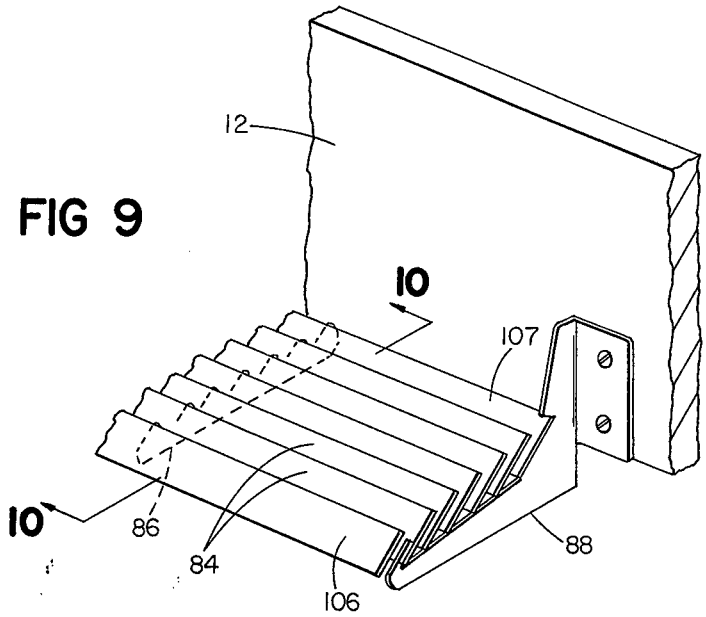
FIG. 9 is a fragmentary, isometric view of another embodiment of the disperser including bracket mounting means therefor.

Referring to FIG. 1 of the drawings, a disperser 18 is attached to the side of a building 10 on vertical facia board 12 below the edge 16 of roof 14. The disperser 18 is positioned adjacent the base of facia board 12 spacing it below roof edge 16 a limited distance in the path of water falling therefrom and, as shown, spacing it substantially above the ground.

Disperser 18 includes mounting means 20 having a vertical base 22 positioned against facia board 12 and secured thereto by screws 24, best shown in FIGS. 2 and 4. In the embodiment illustrated in FIGS. 1–4, mounting means 20 comprises a plurality of mounting brackets (one only is illustrated) having, in addition to bases 22, support arms 26 extending outwardly from bases 22 in a generally horizontal direction. Arms 26 each include an upper straight supporting edge 28 set at a slight angle downwardly from the horizontal, about 10°, in a direction outwardly from base 22 and include a pair of spaced edges 30, 32 at right angles to straight support edge 28.

Disperser 18 also includes a planar member 34 including generally planar, upwardly directed intercepting surface 36 elongated in its dimension parallel to building 10. Planar member 34 is positioned with the elongated dimension of intercepting surface 36 horizontally aligned with roof edge 16. Intercepting surface 36 extends widthwise, away from board 12, a distance into and intercepting the path of water falling from roof edge 16. Member 34 is supported on support edges 28 of mounting means arms 26. Thus, intercepting surface 36 is angled downwardly away from building 10. Spaced flanges 38, 40 on the elongated outer and inner edges of support surface 36 frictionally engage edges 30, 32 of arms 26 to retain member 34 in place, see FIG. 3. Supplemental fasteners, not shown, may additionally be employed to retain member 34 on arms 26, if desired.

Intercepting surface 36 is interrupted by a plurality of apertures 42 interrupting the width of surface 36 in cross section best shown in FIGS. 3 and 4. Deflecting surfaces 44, louvers in the illustrated embodiment, are connected to intercepting surface 36 at each aperture 42. The apertures 42 and deflecting surfaces 44 are elongated in the same direction as intercepting surface 36. The deflecting surfaces 44 are inclined downwardly in one direction from intercepting surface 36, at an angle of about 35° in the preferred embodiment, the deflecting surfaces 44 connected to the side of apertures 42 adjacent mounting means 20 defining channels directed downwardly, at an angle of about 45° from the horizontal, and outwardly from building 10. Sets of louvers 44 are interrupted by narrow widthwise extending portions of intercepting surface 36 to provide structural integrity to the member 34 and to receive and locate arms 26 therebetween, preventing transverse dislocation thereof.

In FIG. 5 is illustrated an alternate embodiment in which the mounting means 20 comprises an integral upturned flange 46 of disperser 18. Flanges 38, 40 of the embodiment of FIGS. 1–4, are unnecessary and are omitted in this embodiment. In this embodiment a heating cable 47 to melt ice or snow is shown secured to the disperser 18 against the intercepting surface 36 by a tab 48 in flange 46 and the disperser is made of conductive material, e.g. aluminum.

In FIG. 6 is illustrated an alternate mounting means 20, comprising a bracket 50 having a vertical portion 52 for connection to a facia board, an integral support arm 54 having an upwardly and forwardly extending first tab 56 thereon and a leg 58 at the end thereof remote from vertical portion 52 with a second tab 60 facing downwardly and toward vertical portion 52. The inner edge 35 of member 34 fits under first tab 56, which locates the inner edge, and leg 58 is received in an aperture 62 in primary surface 36, second tab 60 locking over primary surface 36.

In FIG. 7 yet another alternate mounting means 20 is illustrated, comprising a bracket 70 in which the support arm 72 is divided into three segments 74, 76, 78, the middle element 76 spaced slightly above elements 74, 78 to frictionally receive and engage member 34 therebetween.

In FIG. 8, disperser 18 is shown in combination with rain guide 80 which may be integral therewith, as illustrated or which may be separate. Guide 80 comprises an arcuate surface 82 abutting roof 14 at edge 16, roof 14 essentially tangent to the arc of surface 82. Surface 82 curves downwardly from roof edge 16 as a curved extension of roof 14 and terminates over disperser 18. Water from roof 14 will follow the curved surface 82 of guide 80 to fall upon disperser 18 in a more controlled fashion than if permitted to follow a trajectory from roof edge 16.

In FIG. 9 is illustrated an embodiment, presently preferred, of a disperser comprising longitudinal, parallel stringers 84, positioned and retained by structural supporting elements 86 which run transverse to the stringers 84. Typical mounting means is shown as the bracket 88 which is attached to the facia by screws through holes as shown. In practice, stringers 84 preferably consist of aluminum strips 0.600 inch wide, 0.032 inch thick, and 6 feet long. However, these are stated as preferred dimensions, but other values can serve as well within the spirit of this invention.

Figure 10:
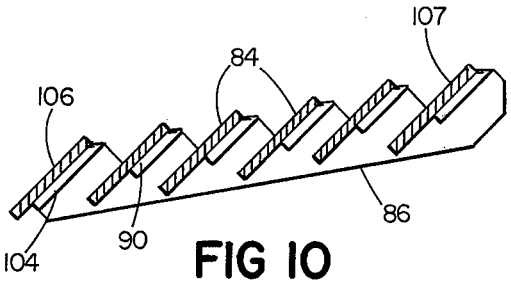
FIG. 10 is a sectional view taken along the line 10—10 of FIG. 9.

As shown in FIG. 10, stringers 84 are supported by, and bonded to, tabs 90, said tabs being integral parts of transverse element 86. In preferred embodiments stringers 84 and tabs 90 are bonded by resistance or ultrasonic welding means, but other means such as epoxy may also be used.

Figure 11:
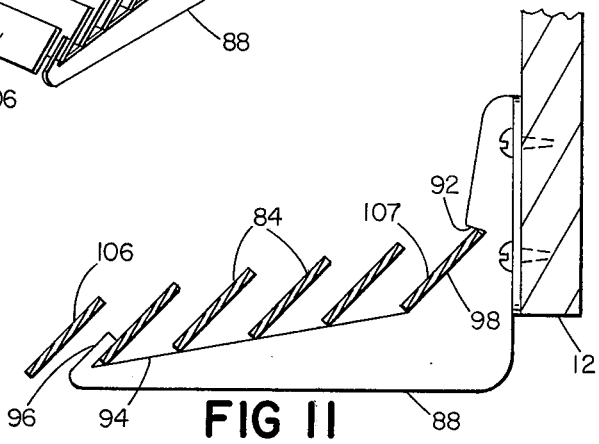
FIG. 11 is an end view of the disperser illustrated in FIG. 9 showing the bracket mounting means and disperser combination in more detail.

In FIG. 11 is shown an end view of the bracket 88 supporting disperser stringers 84 on bearing surface 94 by means of the inherent rigidity of the disperser assembly. Preferably, end tab 96 engages a stringer other than the leading stringer 106, the second stringer being shown engaged by said end tab as an example, impeding forward and upward movement of said engaged stringer; the most rearward stringer 107 lies along inclined surface 98, thereby being impeded in rearward movement, and being engaged by lip 92 is thus impeded from upward movement as well. As a consequence, the disperser assembly, by virtue of its rigidity, is advantageously locked into position. The mounting means illustrated allows a disperser assembly to be snapped into, and unsnapped from, its mounted position by application of force transversely to the stringers at or near the mounting point, said application of force causing transverse flexure of the stringers sufficient to allow passage of stringer 107 past lip 92 after previous engagement by tab 96 such that, upon release of said force element 107 is forcibly retained by said lip, thereby effecting advantageous restraint of the entire disperser assembly.

Figure 12:
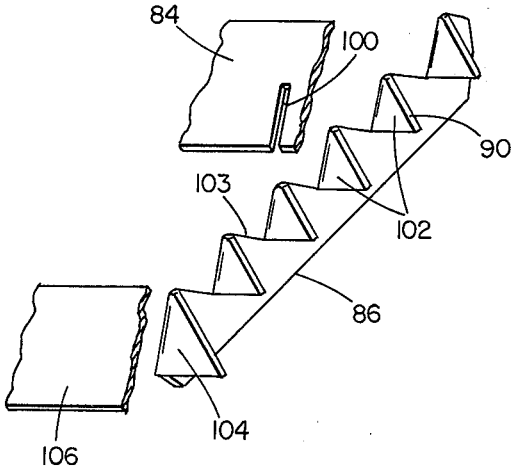
FIG. 12 is a fragmentary isometric exploded view of a transverse spacing structural element and a longitudinal member of the embodiment of FIG. 9.

FIG. 12 illustrates the preferred structure assembly of supporting element 86 and a stringer 84. Tabs 90 are typically cut from element 86 and bent at right angles as shown providing surface portions 102 suitable for bonding stringers 84 thereto. In preferred embodiments stringers 84 are slotted, a typical slot 100 being shown, to engage the adjacent leading wall 103 when assembled on a tab 90, thereby providing advantageous compactness to the disperser assembly. The leading tab 104 preferably engages corresponding leading stringer 106, shown in FIGS. 10 and 11, such that said leading stringer need not be slotted, being held solely by its bond to said tab 104, thereby presenting a preferred continuous appearance as illustrated in FIG. 9.

Figure 13:
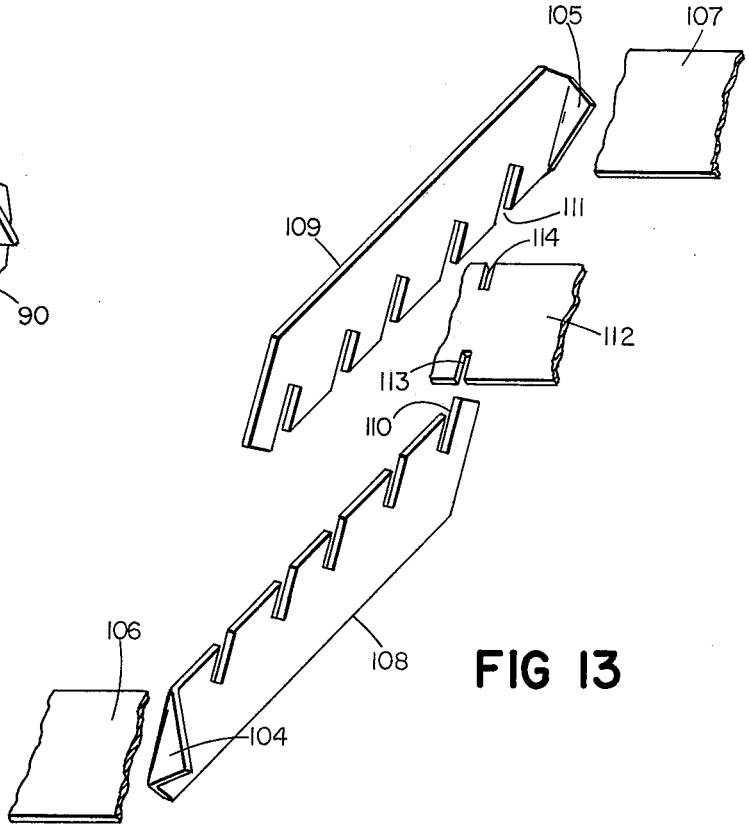
FIG. 13 is a fragmentary isometric exploded view of another means of retaining transversely the longitudinal members of the embodiment in FIG. 9.

FIG. 13 illustrates another embodiment of a structural supporting element in two parts 108, 109 associated with the disperser assembly of FIG. 9. In this embodiment two identical members 108 and 109 are used in opposing fashion, element 109 being element 108 rotated 180°, the while remaining substantially parallel to the latter. Members 108 and 109 contain slots 110, 111 positioned so as to receive stringers, typically shown as 112. Slots 110 and 111 are positioned opposite each other and engage corresponding stringer slots 113 and 114, respectively, upon mutual and opposing closure, said closure being touching and substantially parallel contact of 108 and 109. Stringer 112 is thereby mechanically retained between 108 and 109 by aforesaid slotting means, said elements 108 and 109 being bonded together by welding, crimping, or epoxy means. Leading and trailing stringers, 106 and 107, respectively, are bonded to tabs 104 and 105 integrally formed from members 108, 109 to complete the assembly.

In use, mounting means 20 or 88 are secured to facia board 12 to position members 34 or 84 a limited spaced distance below roof edge 16. Rain water run-off from roof 14 falls freely from roof edge 16 to members 34 or 84 and deflecting surfaces 44 or 84. The force of impact of the stream with surfaces 44 or 84 causes the stream to be broken up. Some splashing may occur causing a random dispersal of some water over the disperser outer edge. A major portion of the water, however, passes through the apertures between surfaces 44 or 84 in a multiplicity of separate paths outwardly away from building 10. Thus, the initial stream of water from roof 14 is separated and directed by such means away from the building to fall in a shower of separate sprays in a random dispersal pattern on the ground over an extended area. The dispersal effect is enhanced as adjacent sprays from deflectors 44 or from elements 84 typically collide with each other from time to time. The deleterious effects of water falling directly to the ground from roof edge 16 are avoided without the necessity of employing gutters with their several disadvantages.

Other embodiments of this invention will occur to those skilled in the art which are within the scope of the following claims.

What is claimed is:

1. A rain water run-off disperser capable of intercepting the consolidated flow of water run-off from a roof of a building and, without collection, dispersing it in a non-erosive shower of water over an extended area of ground, said disperser comprising a disperser structure adapted for mounting in a position horizontally aligned with and spaced a distance below the edge of a roof and a substantial distance above the ground in the path of water falling from said roof, said disperser structure being elongated and of width sufficient to intercept the path of the falling water, said disperser structure defining a multiplicity of separate paths constructed to separate into a dispersed shower downwardly the consolidated flow of water run-off intercepted by said disperser structure and cooperative non-collecting mounting means for said disperser structure, capable of supporting said disperser structure in said position without impeding the flow of water to and through said disperser structure in shower to the ground.

2. The disperser claimed in claim 1 in which said disperser structure defining a multiplicity of separate paths comprises a plurality of apertures extending downwardly through said structure and distributed across the width thereof, said width in cross-section interrupted by a plurality of said apertures, and a plurality of deflecting surfaces at said apertures and inclined in a direction downwardly to disperse said falling water in said shower outwardly and away from said building.

3. The disperser claimed in claim 2 in which said apertures and said deflecting surfaces are elongated in the direction of elongation of said disperser structure.

4. The disperser claimed in claim 1 including a heating cable on said disperser structure.

5. The disperser claimed in claim 1 including, in combination, a guide member for disposition against said roof edge comprising an arcuate surface tangent to said roof curved downwardly away from said roof edge toward and terminating in a position spaced above said disperser.

6. The disperser claimed in claim 1 mounted on a building, said disperser spaced a limited spaced distance below said roof edge substantially above the ground and horizontally aligned below said roof edge in the path of water falling therefrom.

* * * * *